United States Patent [19]

Kranz et al.

[11] 4,189,312

[45] Feb. 19, 1980

[54] WEIGHT RATIO MIXING OF VOLATILE CONTAINING CARBONACEOUS MATERIALS WITH MATERIALS TO BE TREATED BY THE VOLATILES EVOLVED THEREFROM

[75] Inventors: Ray E. Kranz; John B. Harrell; William E. Solano, all of Pittsburgh, Pa.

[73] Assignee: Salem Furnace Co., Pittsburgh, Pa.

[21] Appl. No.: 868,696

[22] Filed: Jan. 11, 1978

Related U.S. Application Data

[63] Continuation-in-part of Ser. No. 627,704, Jan. 5, 1976, abandoned.

[51] Int. Cl.[2] ..... C21B 13/04

[52] U.S. Cl. ..... 75/34; 75/36

[58] Field of Search ..... 423/175, 177; 75/3, 75/4, 5, 29, 33, 34, 35, 36

[56] References Cited

U.S. PATENT DOCUMENTS

| | | | |
|---|---|---|---|
| 2,453,050 | 11/1948 | Turbett | 75/4 |
| 2,687,879 | 8/1954 | Herligenstaadt | 423/175 |
| 3,227,627 | 1/1966 | Asquini | 201/27 |
| 3,443,931 | 5/1969 | Beggs et al. | 75/36 |
| 3,469,970 | 9/1969 | Heitmann | 75/33 |
| 3,470,068 | 9/1969 | Kemmerer | 201/33 |
| 3,475,286 | 10/1969 | Kemmerer | 202/117 |
| 3,770,417 | 11/1973 | Kramer | 75/33 |

*Primary Examiner*—L. Dewayne Rutledge
*Assistant Examiner*—Michael L. Lewis
*Attorney, Agent, or Firm*—Frank P. Cyr

[57] ABSTRACT

A process for the simultaneous production of metallized ores and a char. A carbonaceous material such as coal is mixed on a weight ratio basis of about ½ coal to about 1 iron ore to about 1½ or more coal to about 1 iron ore. The coal is mixed on a weight ratio basis with the iron ore within the ratios defined above and the mixture subjected to a heat treatment of between 1800° F. to about 2200° F. within a substantially air tight enclosure wherein in oxidizing atmosphere is provided in the upper portion of the enclosure and a reducing atmosphere is maintained about the materials on the floor of the enclosure. The floor of the enclosure comprises a travelling imperforate hearth with the speed of travel thereof variable so as to vary the residence time of the materials on the floor of the enclosure from the time of deposit of the materials on the hearth to the time of removal of the materials from the floor.

The mixing of the coal and iron ore within the ratios defined above and by varying the temperature conditions within the enclosure along with the residence time of the materials on the floor of the enclosure will result in the production of a highly metallized ore, say in the neighborhood of 85% to 95% metallization or a slightly metallized ore, say in the neighborhood of about 55% to about 65%.

6 Claims, No Drawings

WEIGHT RATIO MIXING OF VOLATILE CONTAINING CARBONACEOUS MATERIALS WITH MATERIALS TO BE TREATED BY THE VOLATILES EVOLVED THEREFROM

PREFERRED EMBODIMENTS

This is a continuation-in-part application of application Ser. No. 627,704, filed Jan. 5, 1976 now abandoned.

Material heat treating apparatus commonly referred to as calciners have been employed in the past for heat treating a volatile containing carbonaceous material such as iron ore, limestone, and the like. The materials to be subjected to a heat treatment and processed within the calciner enclosure can be pre-mixed prior to their feed into the calciner enclosure or the same may be deposited within the calciner enclosure through separate feed means such as roof mounted feed chutes and following their deposit on the floor of the calciner, means are provided within the calciner enclosure to cause mixing and co-mingling of the volatile containing and non-volatile containing materials.

A calciner designed to heat the above referred materials usually comprises a stationary roof, stationary side walls and an imperforate travelling hearth mounted therein which forms the floor of the calciner. Suitable seals are provided between the travelling hearth and the stationary side walls to preclude entry of outside air at this juncture of the calciner enclosure. Gas and/or oil fired burners are mounted in the roof and at the upper portion of the side walls. Also, air or other oxidant admission ports are provided in the roof and at the upper portion of the side walls of the calciner enclosure. Suitable chutes are provided in the roof of the enclosure and the materials to be subjected to a heat treatment therein are fed therethrough and deposited on the floor of the calciner. A plurality of rabbles are mounted in the roof of the enclosure and they extend to a position closely adjacent the floor of the enclosure. During operation of the calciner the roof mounted rabbles will engage with the materials on the floor of the hearth of the calciner to simultaneously mix the materials on the hearth and advance the materials to an outlet provided either in the floor of the hearth or to an outlet provided in the side walls of the hearth.

A calciner constructed in accordance with the structure briefly discussed above is designed to heat treat the materials deposited on the floor of the enclosure to thereby simultaneously produce a char out of the volatile containing materials and a metallized ore if the non-volatile containing material is an iron ore. As can be appreciated, other non-volatile containing materials can be heat treated within the enclosure along with the volatile containing materials to produce other end products, such as lime.

The process contemplated in the present invention makes use of a known process and apparatus which is fully shown and described in prior U.S. Pat. Nos. 3,227,627 to Asquini dated Jan. 4, 1966, and Kemmerer et al 3,475,286 dated Oct. 28, 1969, which patents are incorporated herein by reference. The aforesaid Asquini Patent is directed generally to a process and apparatus for the continuous treatment of materials which yield oxidizable volatile matter under heat. In the Asquini Patent, a travelling hearth is provided within a substantially airtight enclosure and as volatiles are evolved from the materials undergoing treatment on the hearth, the same are caused to co-mingle with air admitted in the upper portion of the enclosure to thus combust to form an oxidizing atmosphere in that portion of the enclosure and the heat generated thereby will, while retaining a reducing atmosphere about the materials on the hearth, heat the roof and side walls of the enclosure and the materials on the hearth will be exposed to such heat to promote a further removal of additional volatiles as described previously. As can be appreciated, once the enclosure has attained a given temperature gradient, and with sufficient volatiles evolved from the materials undergoing treatment on the hearth, the process can then proceed on an autogenetic basis. However, in instances where the materials undergoing treatment on the hearth do not evolve sufficient volatiles to permit the process to be carried out on an autogenetic basis, gas and/or oil burners mounted in the roof and/or side walls of the enclosure may be fired to supply the required additional heat to properly process the materials on the hearth.

Kemmerer et al, U.S. Pat. No. 3,475,286, also incorporated herein by reference, discloses an apparatus for the continuous treatment of materials which evolve volatiles under heat and comprises an oven having a roof and side walls and a rotating hearth forming the floor of the oven. A central outlet is provided in the hearth for the discharge of processed materials and rabbles are mounted in the roof of the oven for rabbling the materials on the hearth and also to direct the same to the aforesaid central outlet. As in the previously discussed Asquini patent, the apparatus of the Kemmerer et al patent is fully capable of operating on an autogenetic basis in the treatment of materials therein with air being admitted into the upper portion only of the oven to combust with volatiles evolved from the materials undergoing treatment. However, if the materials undergoing treatment do not yield sufficient volatiles to permit for the process to be carried out on an autogenetic basis, oil and/or gas burners mounted in the roof and/or side walls of the oven may be fired to supply the required additional heat to properly process the materials on the hearth.

U.S. Pat. No. 3,770,417 entitled "Simultaneous Production of Metallized Ores and Coke" is also incorporated herein by reference. This prior patent in the name of Ray E. Kranz describes and claims a process for the simultaneous production of coke and metallized ores within a calciner enclosure such as described in the above briefly discussed prior U.S. Pat. No. 3,475,286. While prior U.S. Pat. No. 3,770,417 describes generally a process for the simultaneous production of coke and metallized ores, no attempt has been made by this prior patentee to mix the volatile containing materials and non-volatile containing materials on a weight ratio basis so as to improve the yield of the resultant products to thus increase the efficiency of operation of the calciner and likewise to permit the calciner to operate at lesser costs and with better end products.

With the above in mind, it is one of the objects of the invention to provide a means whereby a volatile containing carbonaceous material such as coal or the like can be admixed on a weight ratio basis with a non-volatile containing material such as iron ore and fed onto the floor of a calciner enclosure and subjected to a heat treatment therein with the volatiles evolved from the volatile containing carbonaceous materials combusting therein at the upper portion of the enclosure thus producing an oxidizing atmosphere in the upper portion of the enclosure while maintaining a reducing atmosphere about the materials on the floor of the calciner.

Another object of the invention is to provide a means whereby the admixture on a weight ratio basis of the volatile containing carbonaceous materials with the non-volatile containing materials will maximize the production of a metallic ore yet minimize the amount of volatile containing carbonaceous materials employed for the heat treatment of the combined charge of volatile containing materials and non-volatile containing materials.

Another object of the invention is to mix on a weight ratio basis a volatile containing material and a non-volatile containing material and subject the combined charge to a heat treatment so as to enable production of a metallized ore and a large yield of char.

Another object of the invention is to mix the coal and iron ore on a weight ratio basis of between about ½ coal to about 1 ore to about 1½ or more coal to 1 ore and by varying the temperature within the calciner enclosure of between about 1800° F. to about 2200° F., and by also varying the residence time of the materials on the hearth of the enclosure, a degree of metallization of between about 85% to about 95% of the ores can be obtained or a lesser degree of metallization of the ores, say in the neighborhood of about 55% to about 65% can be obtained from the ores in carrying out the instant process of metallization of iron ore.

Another object of the invention is to provide a means whereby the residence time of the combined charge of volatile containing materials and the non-volatile containing materials on the floor of the hearth may be varied along with the calciner temperature so as to obtain either a highly metallized ore or one which has only been slightly metallized.

In the direct reduction of metallized ores wherein the same is mixed with a volatile containing material such as coal and subjected to a heat treatment within a calciner enclosure such as shown and described in the aforesaid U.S. Pat. No. 3,475,286, it is desirous, of course, that the calciner be operated under the most efficient conditions so as to bring about the desired resultant products. That is, the calciner be operated to bring about a maximum percentage of metallization of the ores or if a lesser percentage of metallization of the ores is desired, the calciner can be operated so as to produce an ore which is of lesser percentage of metallization. Also, if a large amount of char is desired from the combined charge of volatile and non-volatile containing materials, the ratio of carbonaceous materials fed into the calciner can be increased to thus produce an increase in yield of char whereas if a lesser amount of char is desired from the combined charge of volatile and non-volatile containing materials, a lesser amount of carbonaceous materials is mixed on a weight ratio basis with the ore so as to produce a lesser amount of char.

In carrying out the object of the present invention, it is pointed out that there are certain variables which must be considered in order to operate the calciner in such a manner as to bring about the desired yield of char and metallized ores.

First, the maximum bed temperature within the calciner enclosure may vary from 1800° F. to 2200° F.

Second, the mixture on a weight ratio basis of the volatile containing material such as coal and the non-volatile containing material such as iron ore may vary from a mixture of ½ coal to 1 ore to a 1½ coal or more to 1 ore, depending on the reactivity of the coal, calciner temperature, and amount and quality of char and metallized ores desired as resultnat products.

Third, the range of metallization of the iron ore can vary from about 55% to about 95%.

Fourth, the residence time of the materials on the hearth may be regulated by adjusting the rate of travel of the hearth.

Fifth, the iron content in the ore composition may be anywhere between about 25% iron to about 65% iron, and, Sixth, the bed depth of the materials on the hearth may vary from about 5 inches to about 12 inches.

In the production of metallized ores employing the calciner disclosed in the U.S. patents discussed above, one is able to produce either a highly metallized ore or a slightly metallized ore. A highly metallized ore may be in the range of 85% to 95% metallization whereas a slightly metallized ore may be in the range of 55% to 65% metallization. As stated previously, the degree of metallization may be varied according to one or more of the aforementioned variables. If a highly metallized ore is desired as an end product, the calciner temperature may be in the range of 2000° F. to 2200° F. and the residence time of the materials on the hearth may be in the neighborhood of 4 hours and the coal may have between about 5% to 40% volatile matter. In the production of a highly metallized ore, the rate of travel of the hearth will vary depending on the volatile content and reactivity of the coal coupled with the calciner temperature. The rate of speed of the hearth will determine the residence time of the combined charge on the hearth from the time of feed thereof on to the hearth to the time discharge of the materials from on to the hearth to a suitable exit or receiver means. In the production of a lesser metallized ore, say one in the range of between about 55% to about 65% metallization, the temperature within the calciner may be in the neighborhood of between 1800° F. to 2000° F. and the residence time of the materials on the hearth will be of lesser residence time, say in the neighborhood of 2 hours.

The iron content in an ore composition employed in the formation of a metallized ore will vary depending on where the ore is mined. However, the iron content in the ore can be easily ascertained by known methods of analysis and depending on the amount of iron in the ore, the quality of the metallized ore from a combined charge of iron ore and coal may be varied according to the reactivity of the coal, calciner temperature and residence time of the materials on the hearth. Likewise, coals derived from different sources or mines will vary in their physical components, such as the volatile matter therein, the ash content, etc. However, it has been determined that a coal will have an average content of volatile matter of anywhere between about 5% to about 40% and the amount of volatile matter in any coal and reactivity of the coal can be easily ascertained by known methods of analysis. As can be appreciated, the more reactive the coal is, the lesser amount of excess coal will be used to produce the end products, namely, the char and the metallized ores.

In tests performed utilizing a calciner such as shown in the aforementioned Pat. No. 3,475,286, it was found that the coal and iron ore can be mixed on a weight ratio basis of about ½ coal to 1 iron to about 1½ or more coal to 1 iron, depending on the constituents of the iron ore as well as the volatile content and reactivity of the coal. If an ore is employed having an iron content of about 65% and it is desired to produce a highly metallized ore, a highly reactive coal can be mixed with the iron ore on about ½ coal to 1 iron ore on a weight ratio basis and the speed of rotation of the hearth can be adjust to vary the residence time of the materials on the hearth to about 4 hours with the calciner temperature set at between about 2000° F. to about 2200° F. so that travel of the combined charge of coal and iron ore on the hearth will result in a metallization of the ore in the order of from about 85% to about 95% when the residence time of the materials on the hearth is about 4 hours. On the other hand, if an ore having a lesser amount of iron therein is employed, say in the neighborhood of 25% iron, such ore can be admixed with a coal of high reactivity on a weight ratio basis of about 1½ coal or more to 1 ore and the combined charge on the hearth can be exposed to a degree heat of between about 2000° F. to about 2200° F. with the residence time of the charge on the hearth to be in the neighborhood of 4 hours so as to bring about a highly metallized ore as an end product with a considerable amount of char. If a lesser metallization of the ore is desired, a coal of lesser reactivity as well as a temperature of between about 1800° F. and about 2000° F. can be maintained in the calciner with a lesser time of residence of the combined charge on the hearth say, in the neighborhood of about 2 hours and this will produce an end product of lesser metallization, say in the neighborhood of about 55% to about 65% metallization.

The most desirable ranges of mixing the coal and iron ore on a weight ratio basis has been determined to be between about ½ coal to 1 iron and 1½ coal or more to 1 iron. These percentages have been derived following employing ores having an iron content of about 65%. While the iron ore employed in the performance of several tests had an iron content of about 65%, it is also possible to metallized the ores in an iron ore having a lesser amount of iron, say in the neighborhood of 25% to 30% or more. However, in the processing of the ores having these lesser percentages of iron, the weight ratio of the coal with respect to the ore would be decreased, and the residence time of the materials would be adjusted to give the desired degree of reduction. For a lower grade ore, one which has a lesser amount of iron, say in the neighborhood of 25% to 30%, less coal is required for reduction since less iron is present.

The mixture of the carbonaceous materials with the iron ore so as to bring about an end product being a highly metallized ore or a slightly metallized ore from the combined charge of materials in the calciner has been calculated from tests conducted wherein an ore having an iron content of about 65% or iron therein was employed and a coal having a volatile content therein of between about 28% to about 38% mixed therewith on a weight ratio basis within the percentages stated previously. The process was carried out at temperatures between 1800° F. and 2200° F. and has resulted in the production of char from the carbonaceous materials while still attaining a high metallization of the ore or one which is only partially metallized. Should it be desired to produce a large amount of char as a resultant product along with the metallized ores, a higher ratio of coal can be mixed on a weight ratio basis with the ore. For the production of a high resultant char, the materials can be mixed on a weight ratio of 1½ or more coal to 1 ore depending on the amount of char one wishes to produce as an end product.

A number of tests were conducted employing a calciner such as shown in the aforementioned U.S. Pat. 3,475,286. The iron ores employed in conducting the tests had an iron content of about 65% and the coal had a volatile content of about 28%. In one test, the materials were mixed on a weight ratio basis of about ½ coal to 1 ore and the combined materials fed on to the hearth of the calciner to a depth of about 6 inches. The calciner temperature was maintained at about 1850° F. and the residence time of the materials on the hearth was about 4 hours. Following the heat treatment of the aforesaid materials for this period of time, the resultant product showed about 85% metallization of the iron ores with a small amount of char.

In another test conducted and employing the same calciner as that employed in the first above-mentioned test, an iron ore having an iron content of about 65% was mixed with a coal having a volatile content of about 28%. The combined materials were mixed on a weight ratio basis of about 1½ coal to 1 iron and fed on the floor of the hearth to a depth of about 4 inches. The calciner temperature was maintained at about 2000° F. for a period of about 2 hours. The resultant product was an 85% metallization of the iron ore with a larger amount of char. While the residence time is only 2 hours, it will be noted that the coal is mixed on a weight ratio basis of about 1½ coal to 1 ore.

In still another test conducted employing the same calciner as that employed in the previous tests, and wherein a lesser metallization of the ore is desired, an iron ore having an iron content of about 65% was mixed with a coal having a volatile content of about 28%. The coal and iron ore was mixed on a weight ratio basis of about 1 coal to 1 iron and fed on to the floor of the hearth to a depth of about 4 inches. The calciner temperature was maintained at about 1850° F. The materials were permitted to remain on the hearth at the aforementioned degree temperature for a period of about 2 hours. The resultant product showed about 65% metallization of the iron ore with a lesser amount of char. It will be noted that while the calciner temperature in this test is the same as in a previous test, the ratio of the coal is on a weight ratio basis of 1 coal to 1 ore and the residence time of the materials on the hearth is only 2 hours which resulted in a lower metallization of the ores.

As can be seen from the above tests, either a high or low metallization of the ores can be obtained by employing the same basis components that is, an ore having an iron content of about 65% iron and a coal having a volatile matter in the neighborhood of between 25% to about 40%. However, the aforementioned tests were conducted employing a coal having a volatile content of about 28%. To realize a high metallization of the ores, the coal can be mixed on a weight ratio basis of about ½ coal to 1 iron and the calciner temperature maintained at about 1850° F. for a period of 4 hours. The resultant product will be about an 85% metallization of the ores with little char remaining as an end product. If it is desired to still obtain about an 85% metallization of the ores with a larger yield of char as an end product, the weight ratio of the coal can be increased to a 1½ or more coal to 1 ore and the calciner temperature operated at a degree heat of between 1800° F. to about 2200° F. to thus not only effect an 85% metallization of the ores but also to produce a larger amount of char is desired as an end product, the depth of the bed on the hearth will be thicker than if a lesser amount of char is desired as an end product.

As indicated in the tests set forth above, the residence time of the materials on the hearth will vary depending on the calciner temperature and reactivity of the coal. As indicated in the first test set fourth above, the residence time of the charge of materials on the hearth was only about 2 hours. However, it will be observed that the calciner was set to operate at about 2000° F. and the resultant product was an 85% metallization of the iron with a resultant larger amount of char.

Also as indicated in the tests set forth above, a lesser metallization of the ores can be obtained by using the same basic components but varying the weight ratio basis to a 1½ coal to 1 ore. Also, in order to obtain a lower metallization of the ore, the calciner temperature is set at about 1850° F. with the residence time of the materials on the hearth set at about 2 hours.

Thus, as can be seen from the above, a high degree of metallization or a lower degree of metallization of the ores can be obtained when an ore having a given percentage of iron content and a coal having a given amount of volatile content are admixed on a weight ratio basis. As set forth in the aforementioned tests, the degree of metallization will in fact be determined by the calciner temperature, reactivity of the coal, as well as the residence time of the materials on the hearth. When a large amount of char is desired as an end product along with a high metallization of the ores, the weight ratio basis for admixing the iron ore with the coal may be as high as 1½ coal or more to 1 iron, thus, of course, increasing the depth of the materials on the hearth.

The coal and iron ore can be pre-mixed on a weight ratio basis as described previously and the combined charge of coal and iron fed on to the hearth of the calciner or, if desired, the calciner may be provided with a plurality of roof mounted feed chutes through which the separate materials can be fed on to the hearth of the calciner and roof mounted rabbles can be employed to stir and mix the combined materials on the hearth. Of course, if the materials are fed through separate feed chutes, the amount of coal on to the hearth will have been previously calculated on a weight ratio basis with the iron ore which is fed through a separate roof mounted feed chute.

While we have described a preferred embodiment of the inventor and have presented a preferred method of practicing the same, it is to be understood that the invention is not limited thereto but may be otherwise variously embodied and practiced within the scope of the following claims.

We claim:

1. A process for producing metallized ores and a char within a substantially air tight enclosure wherein there is provided an oxidizing atmosphere in the upper portion of the enclosure and a reducing atmosphere about the floor of the enclosure, the improvement comprising the steps of mixing a carbonaceous material with an iron ore on a weight ratio basis of about ½ coal to 1 iron ore to about 1½ coal to 1 iron ore wherein the iron content in the ore is between about 25% to about 65% and the volatile content in the carbonaceous material is between about 5% to about 40% then subjecting said mixture to a temperature within the enclosure of between about 1800° F. to about 2200° F. for a period of between 2 hours and 4 hours.

2. The process defined in claim 1 wherein the carbonaceous materials are mixed on a weight ratio basis of about ½ coal to 1 iron ore and the temperature within the enclosure maintained at about 1850° F. and the combined materials retained within the enclosure for a period of about 4 hours to thus effect a metallization of the ores of in the neighborhood of between 85% to 95%.

3. The process defined in claim 1 wherein the carbonaceous material is mixed on a weight ratio basis of about 1½ coal to 1 iron and the combined charge of materials subjected to a temperature of about 2000° F. within the said enclosure for a period of about 2 hours to thus effect a metallization of the ores in the neighborhood of about 85%.

4. The process defined in claim 1 wherein the carbonaceous material is mixed on a weight ratio basis of about 1 coal to 1 iron and the combined charge of materials subjected to a temperature of about 1850° F. within the said enclosure for a period of about 2 hours to thus effect a metallization of the ores of in the neighborhood of 55% to 65%.

5. The process defined in claim 1 wherein the iron content in the ore is in the neighborhood of 65% and the volatile matter in the carbonaceous material is in the neighborhood of 28% and the materials subjected to a temperature of between 1800° F. and 2000° F. in the said enclosure for a period of time between 2 hours and 4 hours.

6. The process defined in claim 3 wherein the materials are subjected to a temperature of about 1850° F. within the said enclosure for a period of about 2 hours to thus effect a metallization of the ores in the neighborhood of 55% to 65%.

* * * * *